US010791835B1

(12) United States Patent
Rapale

(10) Patent No.: US 10,791,835 B1
(45) Date of Patent: Oct. 6, 2020

(54) SAFETOES

(71) Applicant: Sandra Rapale, Beverly Hills, CA (US)

(72) Inventor: Sandra Rapale, Beverly Hills, CA (US)

( * ) Notice: Subject to any disclaimer, the term of this patent is extended or adjusted under 35 U.S.C. 154(b) by 0 days.

(21) Appl. No.: 15/445,894

(22) Filed: May 11, 2017

(51) Int. Cl.
*A47C 21/00* (2006.01)
*A47B 95/04* (2006.01)
*A47C 19/02* (2006.01)

(52) U.S. Cl.
CPC ..... *A47B 95/043* (2013.01); *A47C 19/024* (2013.01); *A47C 21/00* (2013.01)

(58) Field of Classification Search
CPC ..... A47B 95/043; A47C 19/024; A47C 21/00
See application file for complete search history.

(56) References Cited

U.S. PATENT DOCUMENTS

D166,618 S * 4/1952 Lees ..... D6/610
3,941,159 A * 3/1976 Toll ..... F16L 59/022 138/147
4,009,735 A * 3/1977 Pinsky ..... F16L 59/022 138/147
4,323,610 A * 4/1982 Leverich ..... A47B 95/043 428/100
D437,723 S * 2/2001 Lees ..... D6/610
6,647,589 B1 * 11/2003 Youngwith ..... A47C 7/002 16/18 CG
2005/0076445 A1 * 4/2005 MacEachern ..... A47C 7/002 5/663
2012/0061545 A1 * 3/2012 Schneider ..... A47B 91/00 248/345.1
2013/0019410 A1 * 1/2013 Willis ..... A47C 31/00 5/663

* cited by examiner

*Primary Examiner* — Daniel J Colilla

(57) ABSTRACT

A cylindrical bed frame leg foam cover fitted with fabric secured by velcro providing a cushion barrier against painful impact to toes and feet when walking near bed.

4 Claims, 5 Drawing Sheets

FIGURE (1)

SAFETOES

SUMMARY OF THE INVENTION

Keeping feet and toes out of harm's way. Safetoes—bed frame leg-foam covers, provide a cushion barrier against painful impact to toes and feet when walking near bed.

BRIEF DESCRIPTION OF THE DRAWINGS

FIG. 5 shows the Safetoes installed and with an optional slip-on fabric cover with an elephant leg design.

DETAILED DESCRIPTION OF THE INVENTION

Figure 1:
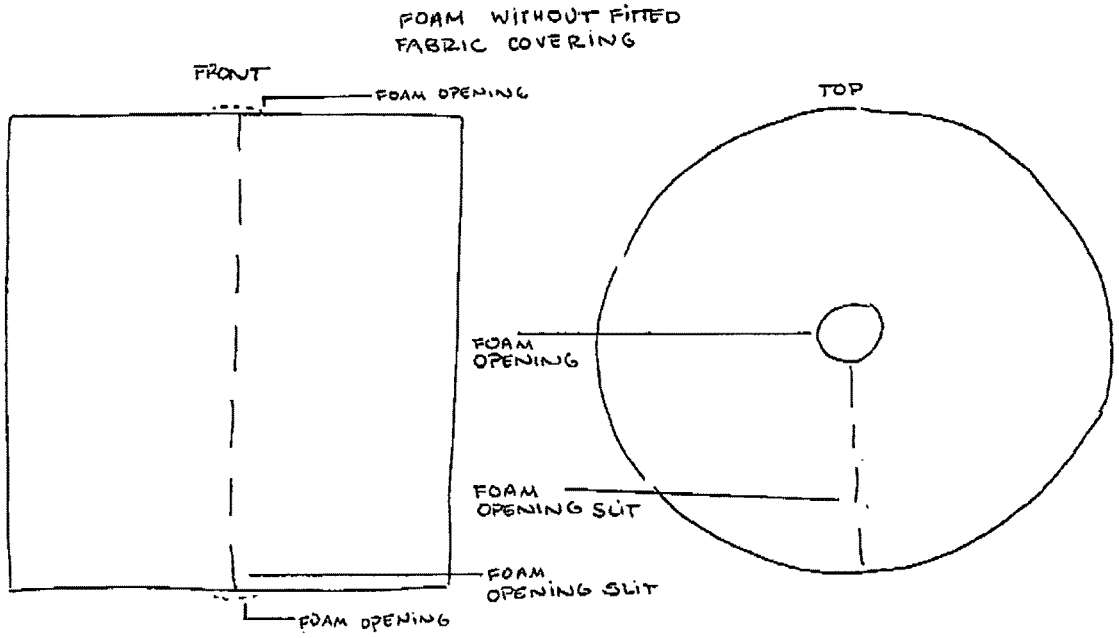
FIG. 1 shows the foam Safetoes without a fitted fabric cover.
Figure 2:
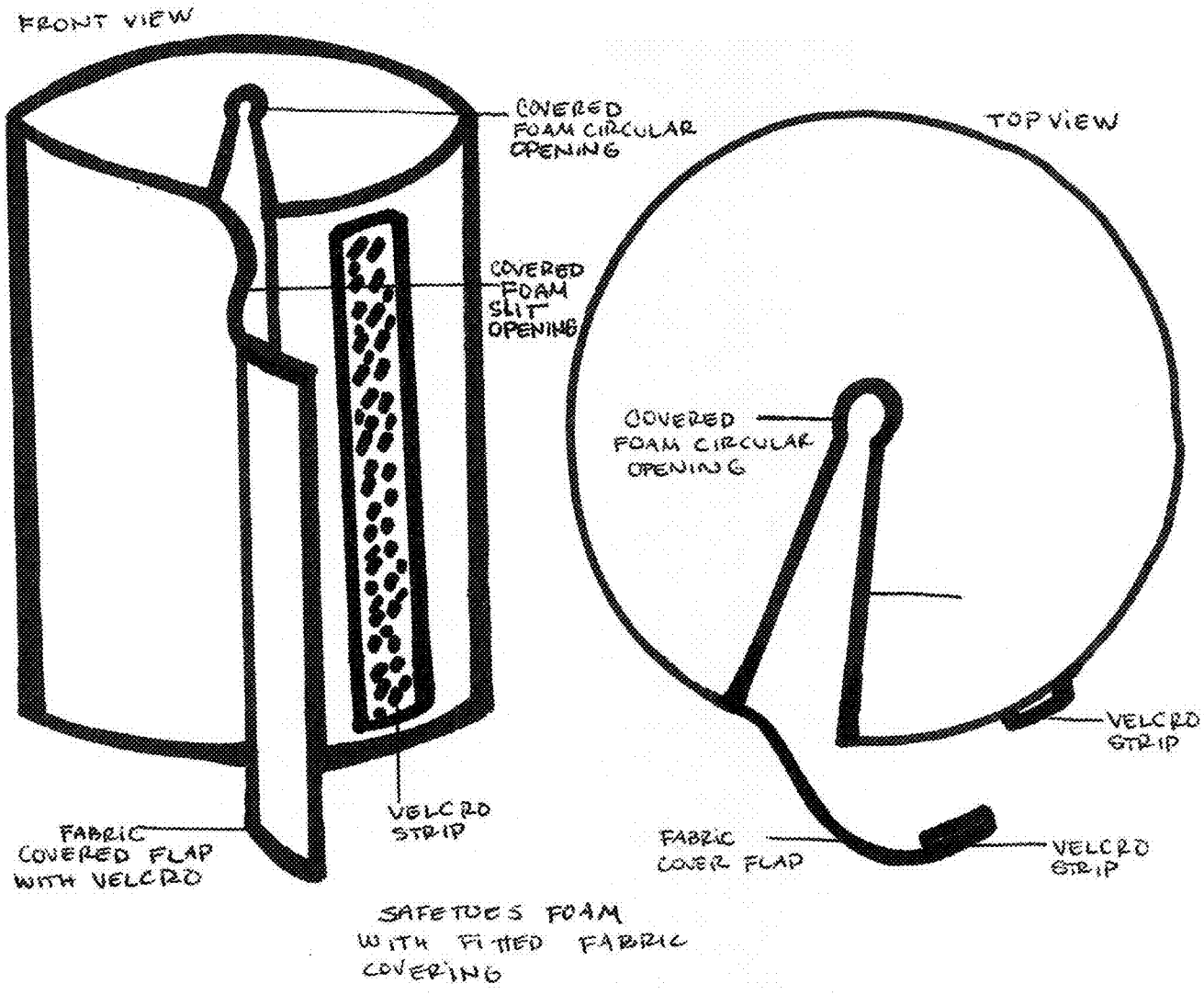
FIG. 2 shows the foam Safetoes with a fitted fabric covering.
Figure 3:
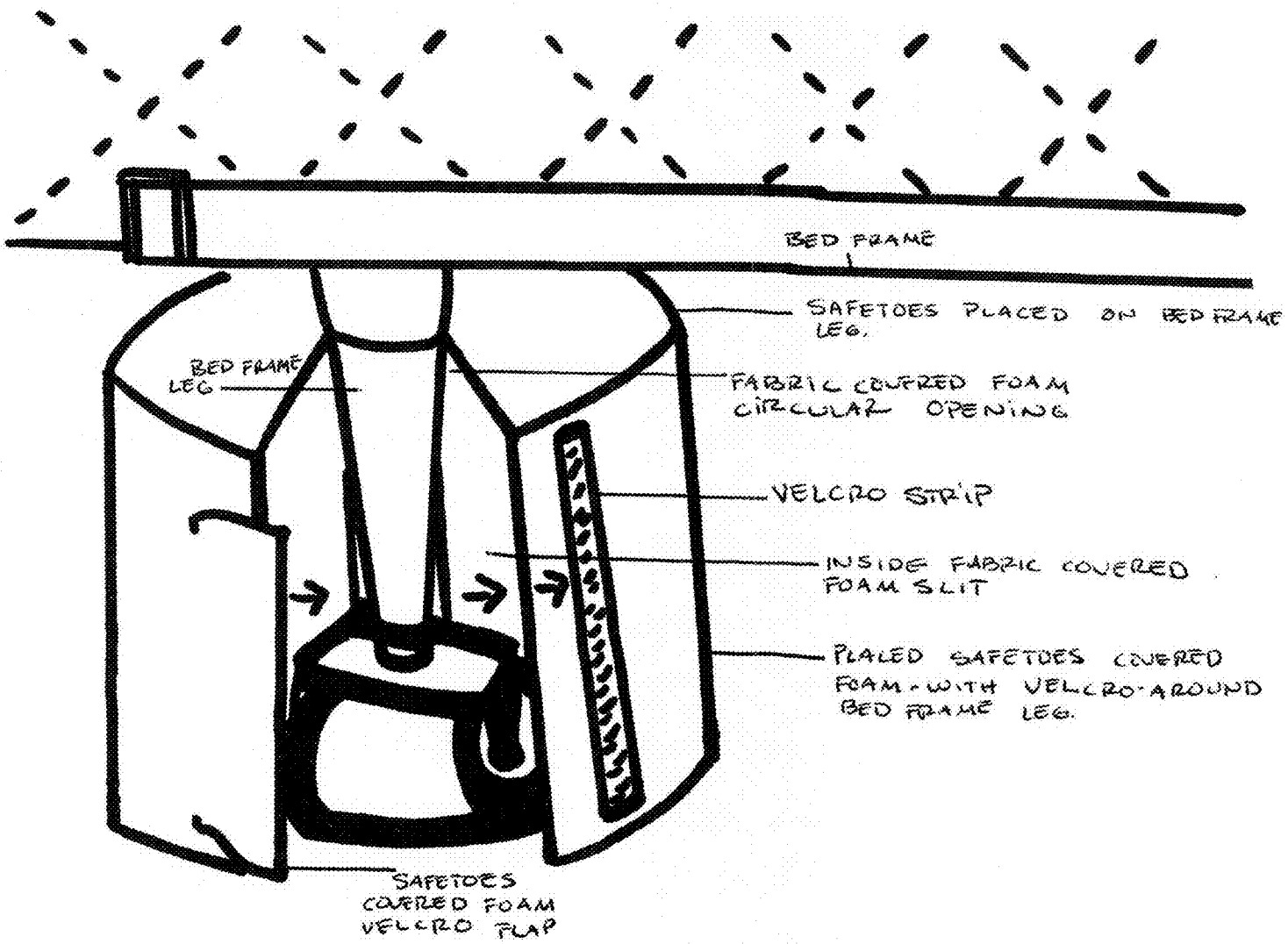
FIG. 3 shows the Safetoes placed on a bedframe leg.
Figure 4:
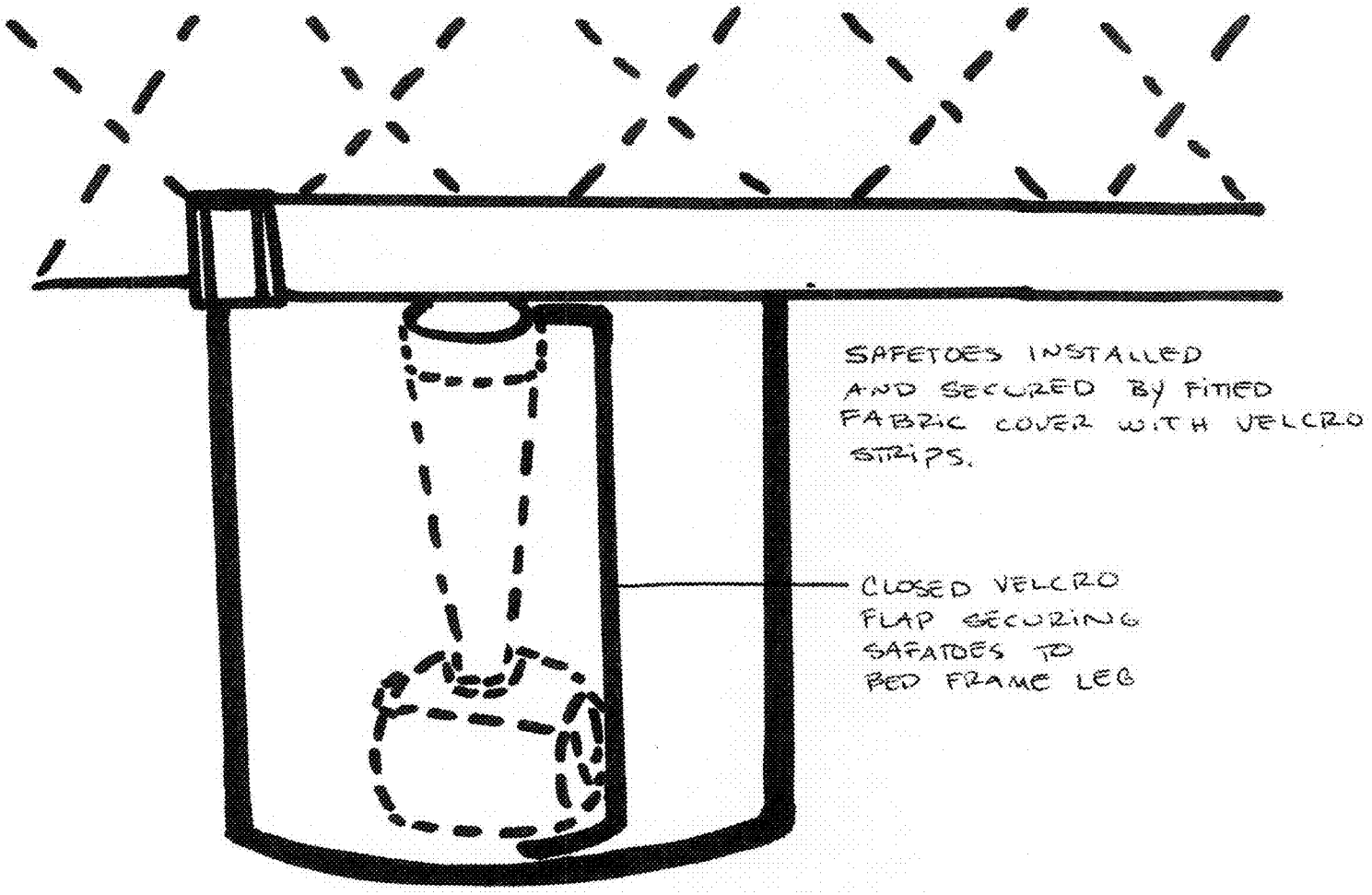
FIG. 4 shows the Safetoes installed and secured by a fitted fabric cover with VELCRO strips.
Figure 15:
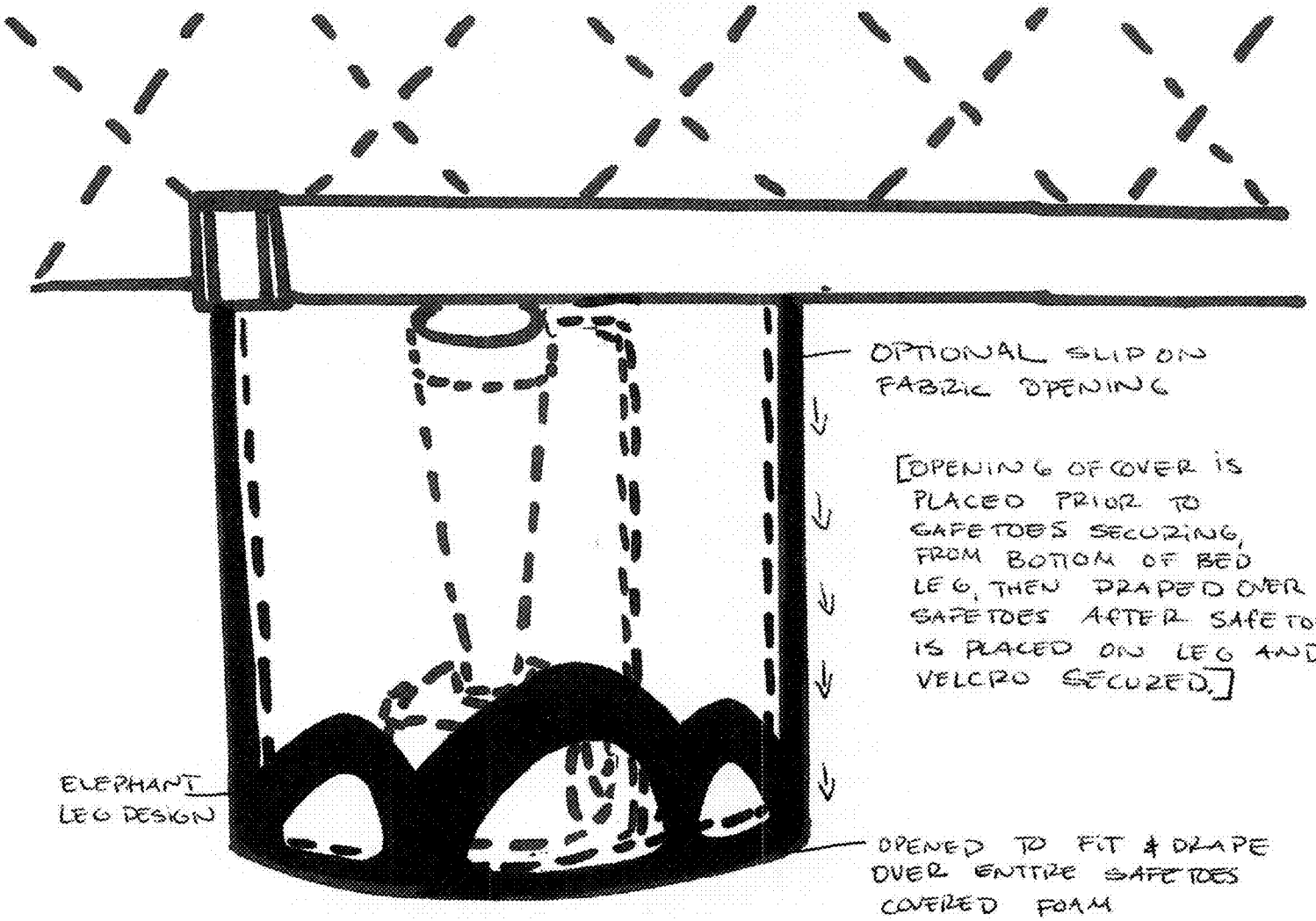

A circular cylinder shaped foam with an opening slit stemming from the center top of cylinder's radius to the center bottom of cylinder's radius allowing for opening of foam cylinder along its side (height) to be placed and wrapped around the bed frame leg. The foam of thick shock absorbing foam allows protection of feet and toes from impact when walking close to bed legs. The foam cylinder is designed (cut) to fit from top of bed frame leg to bottom of bed frame leg covering the bed frame leg from top to bottom and providing cushioned contact with bed frame leg. FIG. (1).

Safetoes cylinder is sewn into a fitted fabric cover which has a flap with VELCRO along the inside end of flap. Once foam cylinder is wrapped around the bed frame leg, the cylinder foam is secured by closing the VELCRO flap over the cylinder's VELCRO tab located along its side. FIGS. (2), (3), and (4).

Optional Safetoes Slip On Design Fabric Cover—Slip On Design Fabric cover with an opening on top to allow the bed frame leg to fit through it. The optional design cover is to be placed prior to securing Safetoes by sliding in from the bottom of the bed frame leg. Once Safetoes is placed and secured with its VELCRO tabs, the design cover is draped over Safetoes and cover from the top of Safetoes to the bottom of Safetoes. Cover designs from color fabrics to match bedroom colors, as well as glow in the dark fabrics to pets and safari animal legs for children's rooms. (Elephant Leg option included in application.) FIG. (5).

The invention claimed is:

1. A bed leg cushion apparatus comprising:

a cylindrical foam cushion member configured to fit around a bed frame leg from a top of the bed frame leg to a bottom of the bed frame leg, wherein the cylindrical foam cushion member is shock absorbing and includes a cylindrical opening extending from a top surface of the cylindrical foam cushion member to a bottom surface of the cylindrical foam cushion member;

an openable slit stemming from the cylindrical opening to an outer surface of the cylindrical foam cushion member and extending from the top surface of the cylindrical foam cushion member to a bottom surface of the cylindrical foam cushion member;

a fitted fabric cover member fitted to said cylindrical foam cushion member and extending around said cylindrical foam cushion member, the fitted fabric cover comprising a flap extension that overlaps a portion of the fitted fabric cover extending around said cylindrical foam cushion member;

a hook and loop fastener strip attached to the flap extension and a mating hook and loop fastener strip attached to the portion of the fitted fabric cover; and a cylindrical aesthetic cover with an opening on a top of the cylindrical aesthetic cover, wherein the cylindrical aesthetic cover is configured to cover the fitted fabric cover member by sliding the cylindrical design aesthetic cover up, over the fitted fabric cover, and wherein the cylindrical aesthetic cover includes aesthetic designs on an outer surface thereof, wherein the bed leg cushion apparatus keeps feet and toes out of harms' way by providing a cushion barrier against painful impact to feet and toes when walking near a bed.

2. The bed leg cushion cylindrical foam core member slit apparatus of claim 1 wherein said slit starts at top center of foam core and ends at bottom center, the cylindrical foam cushion member allows for partial opening of the cylindrical foam cushion member along its side.

3. The bed leg cushion apparatus of claim 1, wherein the cylindrical aesthetic cover comprises a fabric that glows in the dark.

4. The bed leg cushion apparatus of claim 1, wherein the cylindrical aesthetic cover includes a design comprising color fabrics to match colors of a bedroom, pet designs, or safari animal leg designs.

* * * * *